US007927431B2

(12) United States Patent
Olesen et al.

(10) Patent No.: US 7,927,431 B2
(45) Date of Patent: Apr. 19, 2011

(54) SWITCH ASSEMBLY SUPPORT SYSTEM FOR A DISHWASHING APPLIANCE, AND ASSOCIATED APPARATUS AND METHOD

(75) Inventors: Jerry Olesen, Kinston, NC (US); Greg Van Vooren, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 232 days.

(21) Appl. No.: 12/328,281

(22) Filed: Dec. 4, 2008

(65) Prior Publication Data

US 2010/0139717 A1 Jun. 10, 2010

(51) Int. Cl.
*B08B 13/00* (2006.01)

(52) U.S. Cl. ..... 134/57 D; 134/56 D; 134/200

(58) Field of Classification Search ..... 134/56 D, 134/57 D, 200; 68/196
See application file for complete search history.

(56) References Cited

U.S. PATENT DOCUMENTS

| | | | | |
|---|---|---|---|---|
| 4,260,278 | A | 4/1981 | Yartz | |
| 4,765,697 | A * | 8/1988 | Gardell et al. | 312/229 |
| 5,366,185 | A | 11/1994 | Michael et al. | |
| 5,453,586 | A | 9/1995 | Stottmann | |
| 5,544,428 | A * | 8/1996 | Kuroda et al. | 34/493 |
| 6,658,868 | B2 | 12/2003 | Raab et al. | |
| 7,091,932 | B2 | 8/2006 | Astrauskas | |
| 7,338,141 | B2 * | 3/2008 | Kang et al. | 312/265.5 |
| 7,371,984 | B2 | 5/2008 | Lee et al. | |
| 2008/0011342 | A1 | 1/2008 | Ryu et al. | |
| 2008/0196750 | A1 * | 8/2008 | Yoo | 134/57 D |

FOREIGN PATENT DOCUMENTS

| | | | |
|---|---|---|---|
| DE | 199 50 829 | A1 | 4/2001 |
| EP | 0 943 286 | A1 | 9/1999 |
| JP | 07-327908 | * | 12/1995 |
| WO | WO 2006/025667 | A1 | 3/2006 |

OTHER PUBLICATIONS

European Patent Office 0 858 768 Aug. 1998.*
European Patent Office 1 013 215 Jun. 2000.*

* cited by examiner

*Primary Examiner* — Frankie L Stinson
(74) *Attorney, Agent, or Firm* — Alston & Bird LLP

(57) ABSTRACT

A dishwashing appliance is provided, comprising a door assembly defining opposed upper and lower ends. A console cover member is operably engaged with the upper end of the door assembly, and includes a first surface, and a second surface perpendicularly engaged therewith and extending therefrom. A switch assembly within the console cover member has at least one control actuator accessible through the first surface of the console cover member. A support member is configured to operably engage the second surface of the console cover member such that the switch assembly is disposed between the support member and the first surface. The support member is configured to bias the switch assembly toward the first surface so as to compress a gasket member between the first surface and the switch assembly to form a seal therebetween. An associated system and method is also provided.

20 Claims, 6 Drawing Sheets

SWITCH ASSEMBLY SUPPORT SYSTEM FOR A DISHWASHING APPLIANCE, AND ASSOCIATED APPARATUS AND METHOD

BACKGROUND OF THE INVENTION

1. Field of the Invention

Embodiments of the present invention relate to dishwashing appliances and, more particularly, to a switch assembly support system for a dishwashing appliance, and an apparatus and method associated therewith.

2. Description of Related Art

A washing appliance, such as a dishwasher, generally includes a tub portion having a forward access opening, wherein a door assembly is engaged with the tub portion so as to be pivotable about the lower end of the tub portion and to close the forward access opening during the dishwashing process. Some dishwashers are electronically-controlled, implementing a control panel having an electronic control assembly for interacting with various components (i.e., circulation pump, drain pump, water valve) of the dishwasher to control a dishwashing process. In such instances, the performed functions (i.e., wash, rinse, drain) or cycles (i.e., heated dry) may be selected by a user via one or more appropriate selector devices, such as one or more switches, buttons, knobs, or combinations thereof, associated with a control panel. Some dishwashers may further have the control panel thereof disposed within a console assembly about the upper end of the dishwasher door, such that the control panel is substantially hidden when the door is closed. However, placing the control panel and associated selector devices at the top of the door, indeed in the door altogether, may lead to concerns of moisture intrusion into the console and resulting damage to the switches/switch assembly or other selector devices. As such, measures must be taken to appropriately protect the switches/switch assembly or other selector devices from moisture intrusion.

One such measure may be an integrally-molded or otherwise sealed console assembly incorporating the outwardly accessible switch/control surface therein. One limitation with such a sealed console assembly, however, is that the switches/switch assembly must then be secured therein in a water-tight manner, while still allowing the switches to be operated through the console assembly. Since the top of the console assembly is an integral or otherwise sealed member, the switch assembly may have to be inserted or otherwise secured into engagement with the console assembly from underneath the top surface thereof. In some instances, a gasket member may be disposed between the underside of the top surface of the console assembly and the switch assembly to provide a water-tight seal therebetween, but may require some compressive force to be applied thereto for providing such a seal. However, because of the limited height within the console assembly, particularly when the console assembly is engaged about the upper end of the door assembly, securing the switch assembly to the horizontal underside of the top surface may not be possible, may be difficult, or may otherwise not be suited for a production line.

Thus, there exists a need for an apparatus and method for securing a switch assembly to the underside of the top surface of a console assembly in a manner conducive to the manufacturing process, while also providing the necessary force for compressing the gasket member between the underside of the top surface of the console and the switch assembly, without displacing or damaging the gasket member.

BRIEF SUMMARY OF THE INVENTION

The above and other needs are met by the present invention which, according to one aspect, provides a dishwashing appliance comprising a tub portion having a plurality of wall members defining a forward access opening, and a door assembly pivotably engaged with the tub portion about respective lower ends thereof, wherein the door assembly defines an upper end opposed to the lower end thereof. The door assembly is movable between an open position and a closed position with respect to the tub portion, and is configured to cooperate with the tub portion to cover the forward access opening in the closed position. A console cover member is disposed about and operably engaged with the upper end of the door assembly, and has a first surface and a second surface perpendicularly engaged with and extending from the first surface. A switch assembly is disposed within the console cover member. The switch assembly includes at least one control actuator configured to selectively direct operation of at least one operational component of the dishwashing appliance, wherein the at least one control actuator is accessible through the first surface of the console cover member. A gasket member is operably engaged between the first surface and the switch assembly. A support member is configured to operably engage to the second surface of the console cover member such that the switch assembly is disposed between the support member and the first surface. The support member is further configured to bias the switch assembly toward the first surface so as to compress the gasket member between the first surface and the switch assembly to form a seal therebetween.

Another aspect provides a switch assembly support system for a dishwashing appliance having a tub portion defining a forward access opening, wherein a door assembly is pivotably engaged with the tub portion about respective lower ends thereof. The door assembly is movable between an open position and a closed position with respect to the tub portion, and is adapted to cooperate with the tub portion to cover the forward access opening in the closed position. The door assembly defines an upper end opposed to the lower end thereof. The dishwashing appliance further includes a switch assembly having at least one control actuator configured to selectively direct operation of at least one operational component of the dishwashing appliance, wherein the switch assembly has a gasket member operably engaged therewith. Such a switch assembly support system comprises a console cover member configured to be disposed about and operably engaged with the upper end of the door assembly. The console cover member has a first surface, and a second surface perpendicularly engaged with and extending from the first surface, wherein the at least one control actuator is accessible through the first surface. A support member is configured to operably engage the second surface of the console cover member such that the switch assembly is disposed between the support member and the first surface. The support member is further configured to bias the switch assembly toward the first surface so as to compress the gasket member between the first surface and the switch assembly to form a seal therebetween.

Yet another aspect provides a method of forming a door assembly of a dishwashing appliance. Such a method comprises operably engaging a console cover member with and about an upper end of a door member, wherein the console cover member has a first surface, and a second surface perpendicularly engaged with and extending from the first surface. A switch assembly is placed within the console cover member such that at least one control actuator associated with the switch assembly, and configured to selectively direct operation of at least one operational component of the dishwashing appliance, is accessible through the first surface of the console cover member. A gasket member is operably engaged between the first surface and the switch assembly. The method further comprises operably engaging a support member with the second surface of the console cover member such that the switch assembly is disposed between the support member and the first surface, wherein the support member is configured to bias the switch assembly toward the first surface so as to compress the gasket member between the first surface and the switch assembly to form a seal therebetween.

Embodiments of the present invention thus provide advantages as otherwise detailed herein.

BRIEF DESCRIPTION OF THE SEVERAL VIEWS OF THE DRAWINGS

Figure 1:
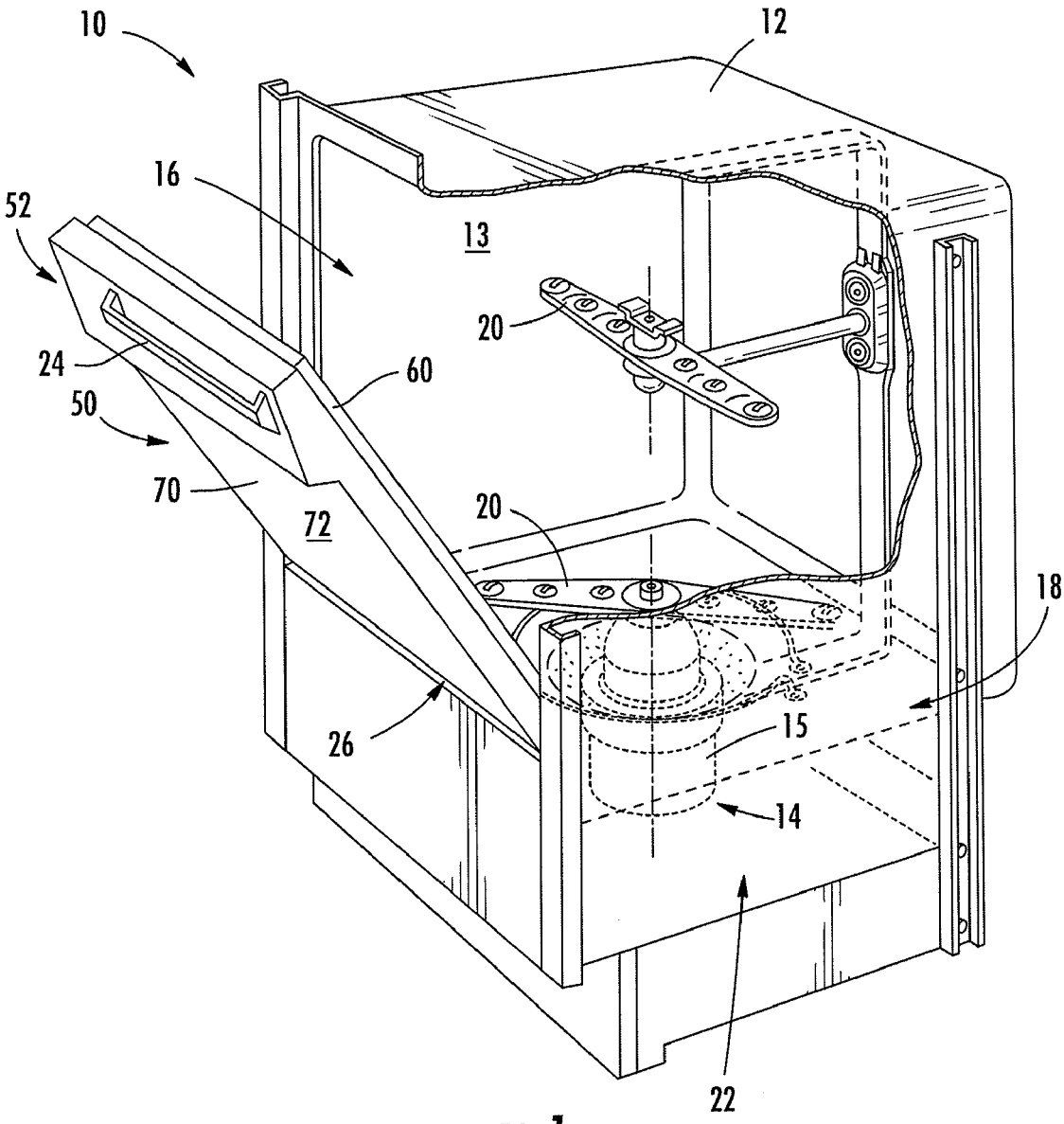
Figure 2:
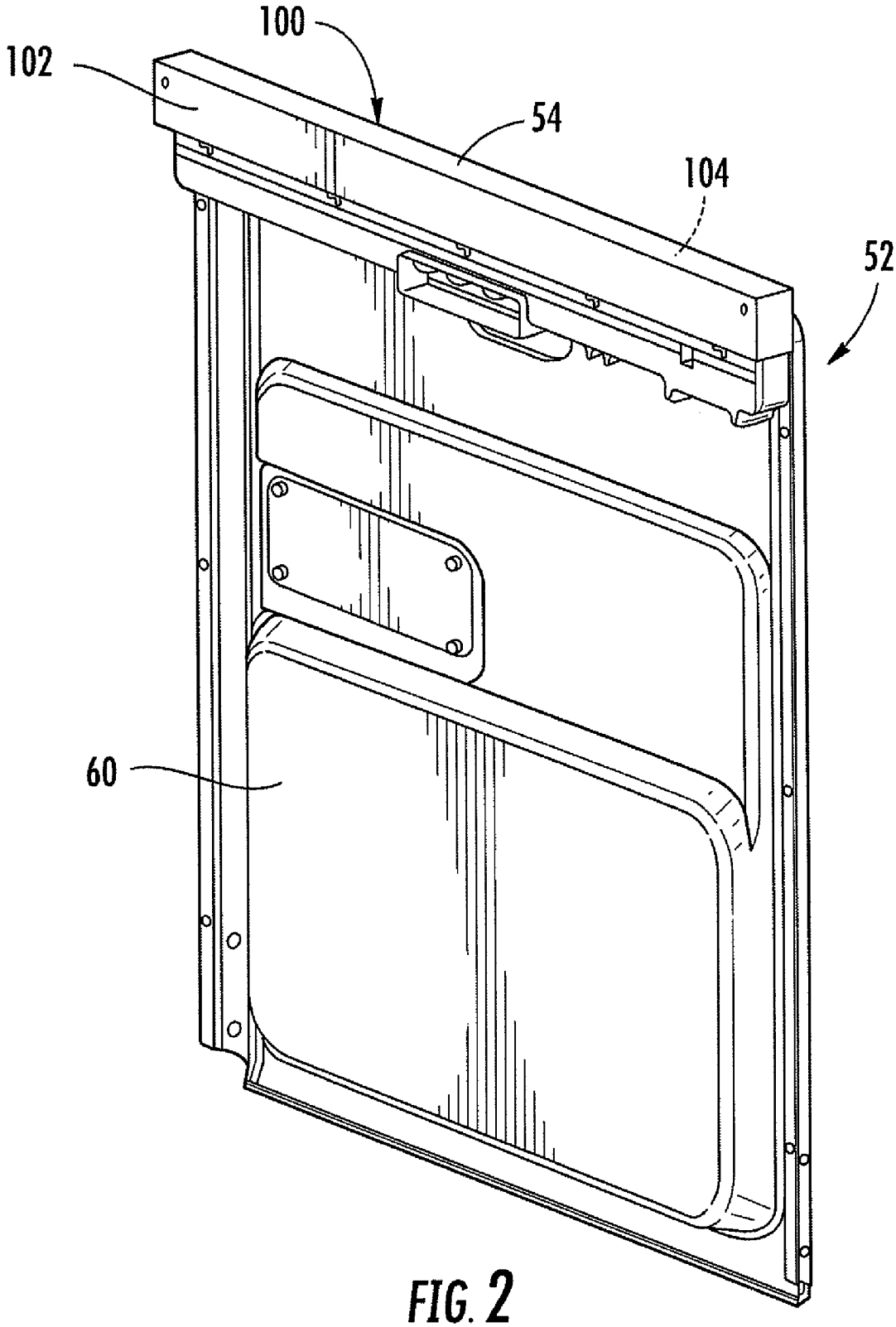
Figure 3:
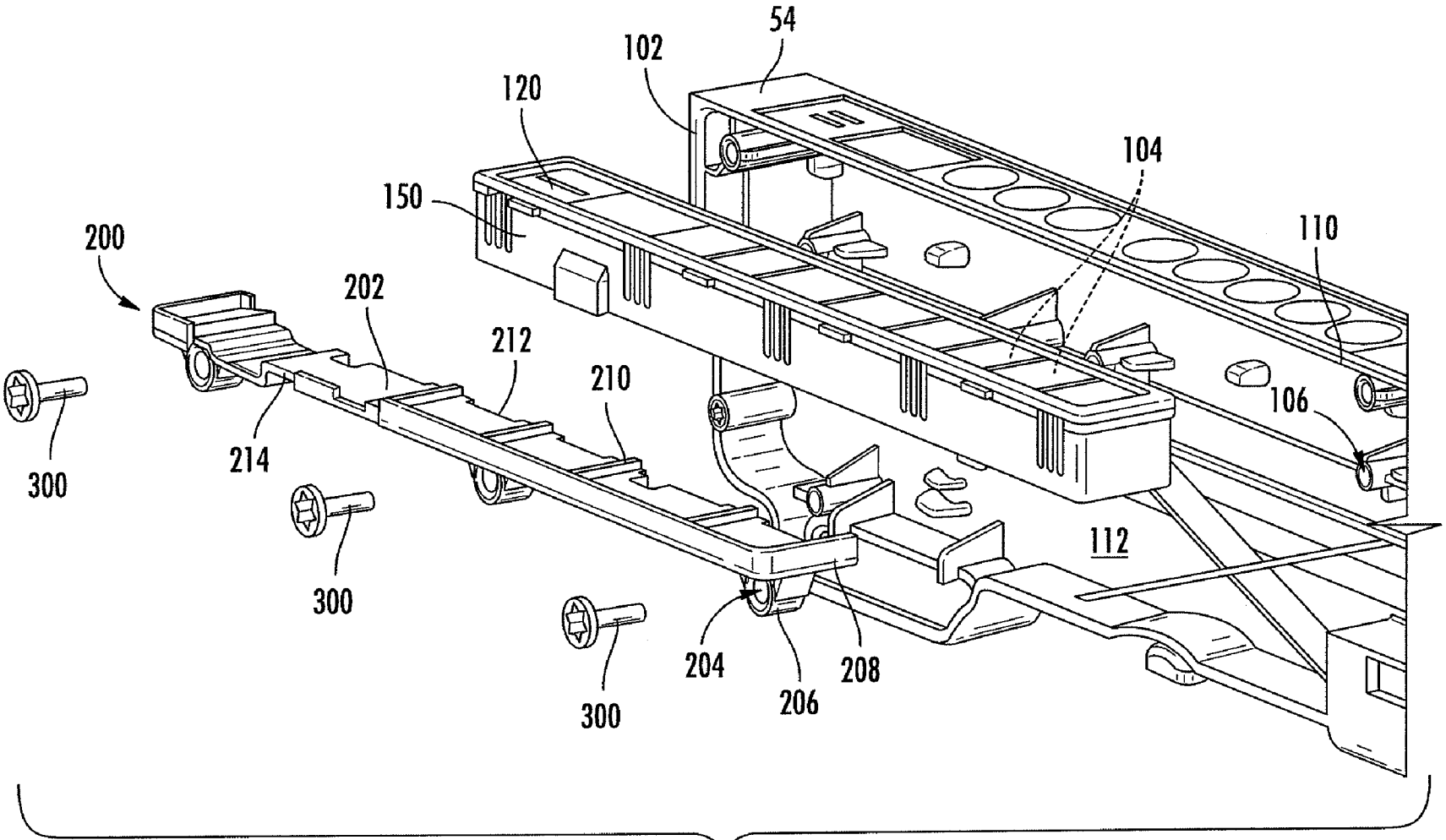
Figure 4:
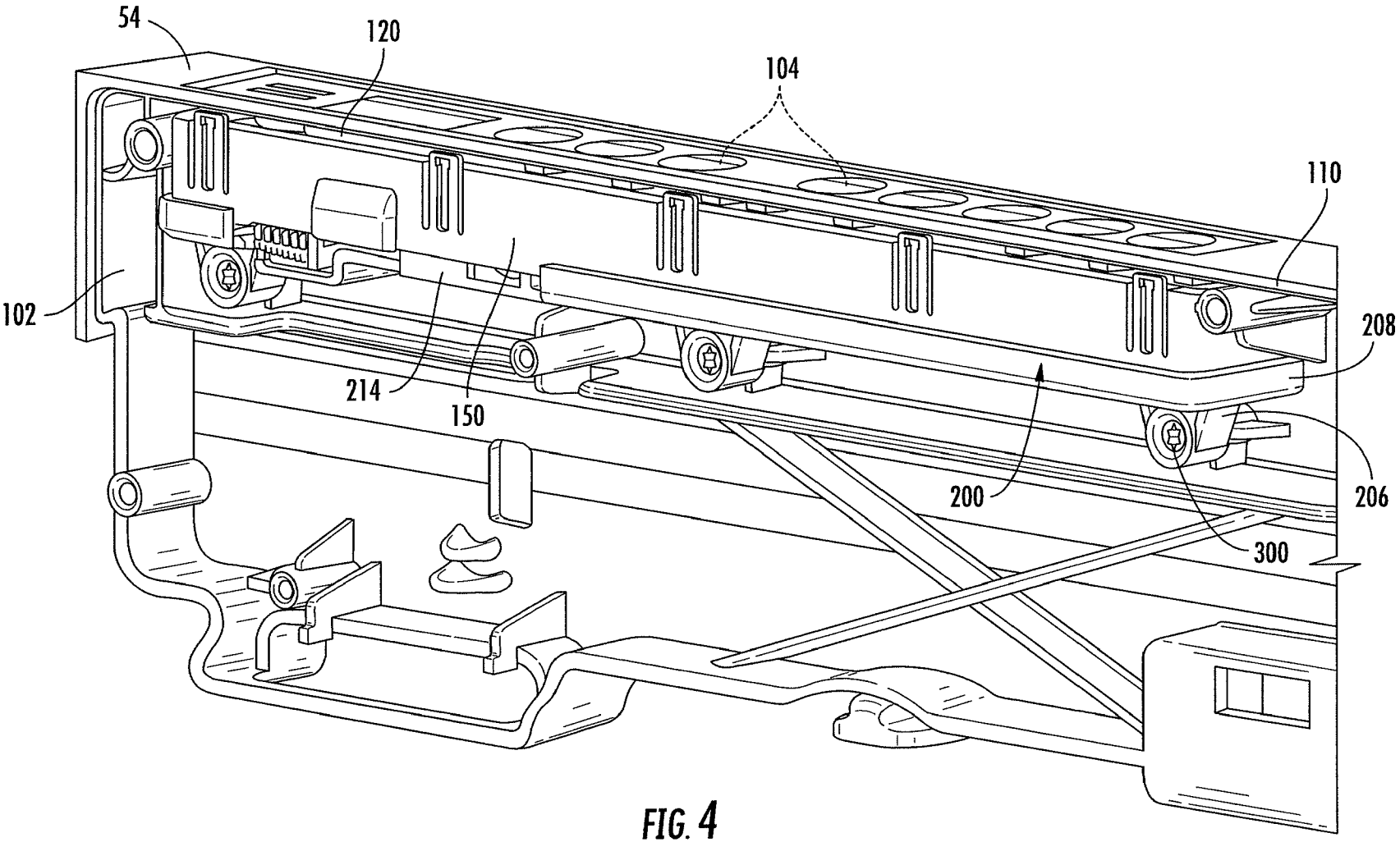
Figure 5:
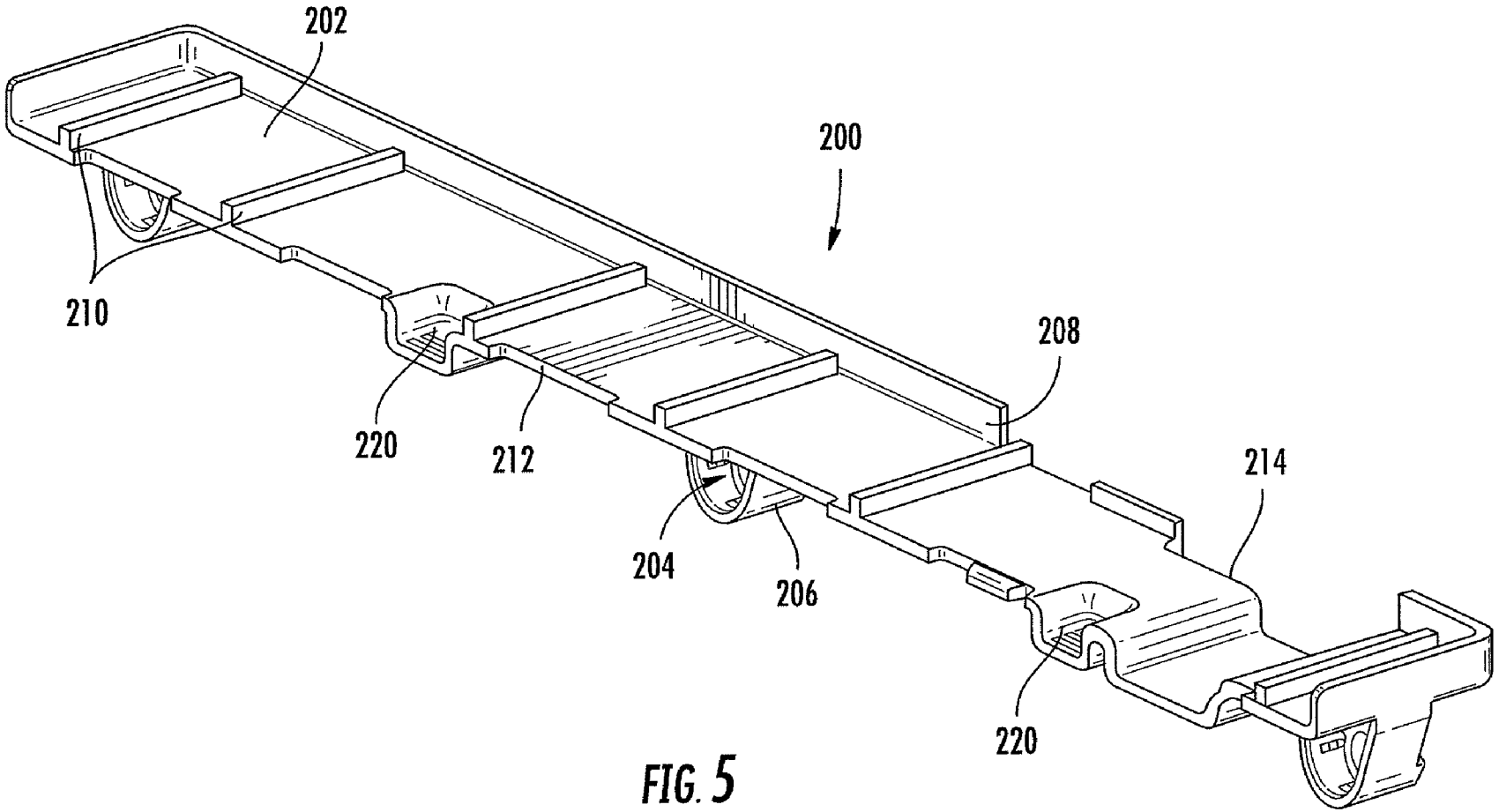
Figure 6:
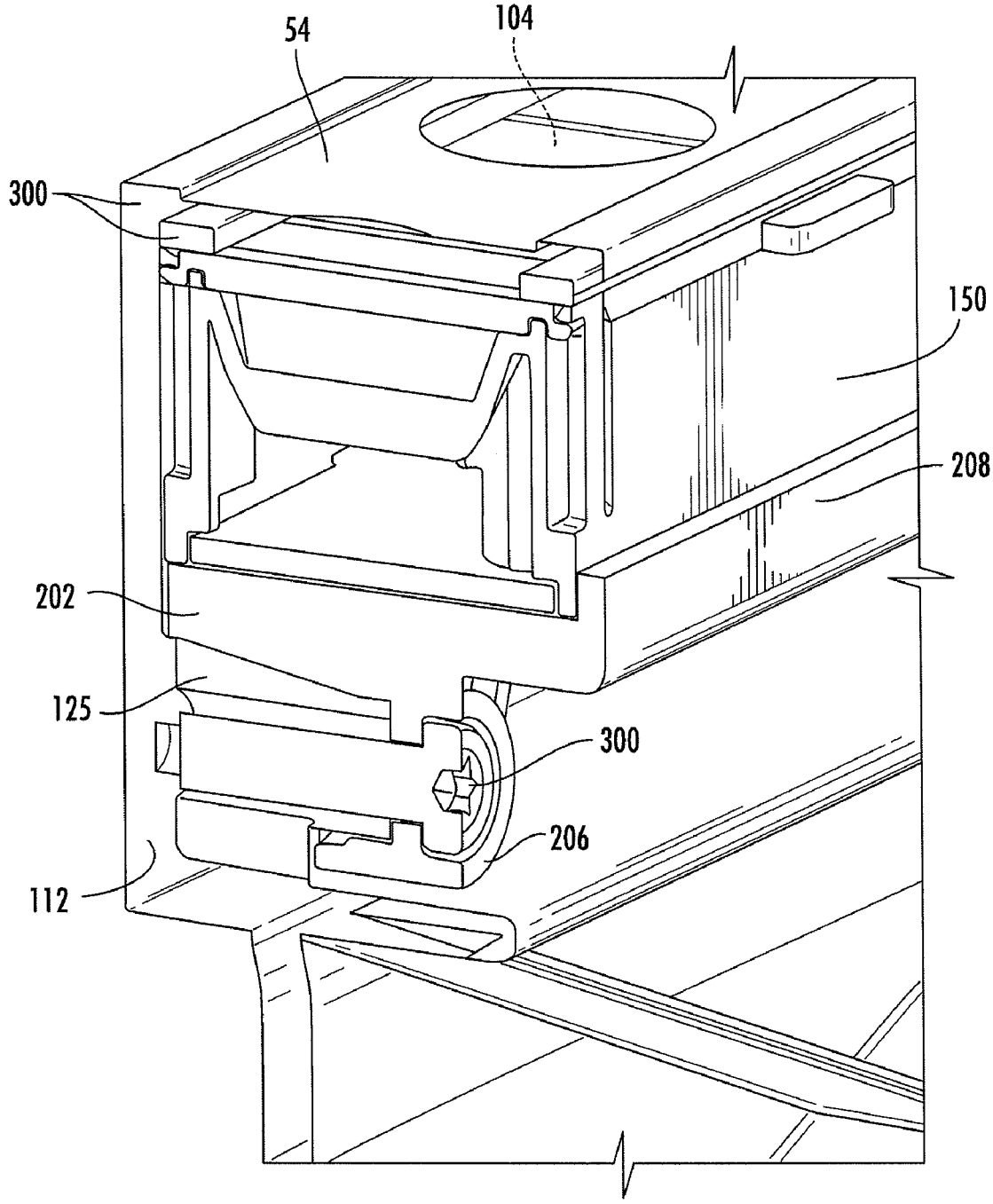

Having thus described various embodiments of the invention in general terms, reference will now be made to the accompanying drawings, which are not necessarily drawn to scale, and wherein:

FIG. 1 is a perspective view of a dishwasher capable of implementing various embodiments of the present disclosure;

FIG. 2 is a perspective view of a dishwasher door assembly having an appearance panel member removed therefrom, wherein a control panel console member is operably engaged with the door assembly about an upper end thereof, according to one embodiment of the present invention;

FIG. 3 is an exploded perspective view of a switch assembly support system for a dishwasher, according to one embodiment of the present invention;

FIG. 4 is a perspective view of a switch assembly support system for a dishwasher, according to one embodiment of the present invention;

FIG. 5 is a perspective view of a support member of a switch assembly support system for a dishwasher, according to one embodiment of the present invention; and FIG. 6 is a cross-sectional side view of a control panel assembly for a dishwasher, wherein the control panel assembly includes a switch assembly support system configured to bias a switch assembly so as to seal the switch assembly with respect to the control panel assembly in a water-tight manner, according to one embodiment of the present invention.

DETAILED DESCRIPTION OF VARIOUS EMBODIMENTS OF THE INVENTION

Various embodiments of present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates one example of a dishwashing appliance, such as a dishwasher 10, capable of implementing various embodiments of the present invention. Such a dishwasher 10 typically includes a tub portion 12 (partly broken away in FIG. 1 to show internal details) having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable lower and upper racks (not shown) for holding the dishes, utensils, and dishware to be washed. The tub portion 12 may define a sump, generally designated as 14, in which wash water or rinse water is collected, typically under the influence of gravity. The wash/rinse water may be pumped by a pump 15 out of the sump 14 to various spray arms 20 mounted in the interior of the tub portion 12 for spraying the wash/rinse water, under pressure, onto the dishes, utensils, and other dishware contained therein. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports a lower end, generally designated as 18, of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

A door assembly 50 may be pivotably engaged with the tub portion 12 about the lower end 18 thereof so as to selectively permit access to the interior of the tub portion 12. That is, a lower edge 26 of the door assembly 50 may be pivotably engaged (i.e., hinged) with the lower end 18 of the tub portion 12 such that the door assembly 50 is pivotable about the lower edge 26 thereof to cover and seal the forward access opening 16 in a closed position (i.e., when the dishwasher 10 is in operation), and to provide access to the interior of the tub portion 12 through the forward access opening 16 when the door assembly 50 is pivoted from the closed position to an open position. In some instances, the door assembly 50 may comprise an inner panel member 60 and an outer (appearance) panel member 70. The door assembly 50 may further include a handle member 24 disposed on an outer surface 72 of the outer panel member 70, wherein the handle member 24 is configured as a grasping provision for allowing the user to open and close the door assembly 50.

As shown in FIG. 2, the dishwasher 10 may include a control panel assembly 100 disposed about an upper end 52 of the door assembly 50 and configured to direct the operation/actuation of various operational components of the dishwasher 10. The control panel assembly 100 may comprise a console cover member 102 for housing or cooperating with the door assembly 50 to cover, for example, a switch assembly 150 (FIGS. 3, 4 and 6), a circuit board, a timer device, one or more control actuators 104 and/or user interfaces, and/or other control unit (for controlling certain aspects of the dishwasher 10). The control unit may be in electrical communication with the one or more control actuators 104 and/or user interfaces, and may be mounted in/on the door assembly 50 of the dishwasher 10 or otherwise associated with the door assembly 50. The control panel assembly 100 may further be in communication, via a wiring arrangement (not shown), such as, for example, a wiring harness, with various operational components (e.g., circulation pump, drain pump, water valve) of the dishwasher 10, wherein such operational components may be controlled via the control panel assembly 100, as initiated through the control actuators 104 and/or user interfaces associated with the door assembly 50.

The console cover member 102 may be mounted, disposed about, or otherwise operably engaged with and/or secured to the door assembly 50 about the upper end 52 thereof. In general, the console cover member 102 may include one surface (i.e., second surface 112) extending substantially parallel to the major plane of the door assembly 50, and another surface (i.e., first surface 110) extending from one edge of and perpendicularly to the first surface (i.e., forming a right angle therebetween). In some instances, the control actuators 104 are accessible via (i.e., on or through) an upper portion 54 of the console cover member 102, but otherwise the control actuators 104 are substantially concealed when the door assembly 50 is in the closed position. The control actuators 104 may be associated with various performed functions (i.e., wash, rinse, drain), cycles (i.e., heated dry), or programs (i.e., light wash, heavy wash) of the dishwasher that may be selected by a user interacting with the control actuators 104 (i.e., by pressing a button(s) or touching the actuator(s) associated with the console cover member 102) disposed about the upper end 52 of the door assembly 50.

As shown in FIGS. 3 and 4, the control panel assembly 100 may comprise a switch assembly 150 for directing operation of various operational components of the dishwasher 10. The switch assembly 150 may comprise at least one control actuator 104 configured to selectively direct operation of at least one operational component of the dishwasher 10. In some instances, the switch assembly 150 may comprise a plurality of control actuators 104 associated with various performed functions (i.e., wash, rinse, drain), cycles (i.e., heated dry), or programs (i.e., light wash, heavy wash) that may be selected by a user interacting therewith such as, for example, pressing a button or touching an actuator of the switch assembly 150 disposed about and accessible through the upper portion 54 of the console cover member 102 (i.e., a physical control button or a touch-sensitive actuator disposed under the upper portion 54 and sensitive to a touch thereof. Associated with the control actuator(s) 104 may be one or more indicia (not shown) associated with or visible through the upper portion 54 of the console cover member 102. The one or more indicia may comprise, for example, artwork, logos, alphanumeric characters, graphic characters, switch functionality indicators, and/or the like for indicating information to the user regarding the function of the control actuator 104 associated therewith. For example, the one or more indicia may indicate a series of control actuators 104 for selecting a light, medium, or heavy wash program.

With continuing reference to FIGS. 3 and 4, the control panel assembly 100 may further comprise a gasket member 120 disposed between the underside/first surface 110 of the upper portion 54 of the console cover member 102 and the switch assembly 150. When operably engaged therebetween, the gasket member 120 may provide a water-resistant seal for preventing moisture intrusion to the switch assembly 150 and/or the control actuator(s) 104 associated therewith. In such instances, the gasket member 120 may be engaged with the switch assembly 150 so as to substantially cover or extend perimetrically about the control actuator(s) 104, wherein the control actuators 104 may be accessible, whether directly or indirectly, through the upper portion 54 of the console cover member 102 (and possibly the gasket member 120). That is, the control actuators 104 may be actuated by, for example, pressing on or touching the upper portion 54 at an appropriate position corresponding to one of the control actuators 104 disposed beneath the upper portion 54. However, in order to provide an appropriate water-tight or water-resistant seal for reducing the likelihood of water reaching the switch assembly 150, the gasket member 120 may require a compressive force to be applied thereto for providing such a seal.

In accordance with embodiments of the present disclosure, with reference to FIGS. 3-6, the dishwasher 10 may thus implement a switch assembly support system 200 having a support member 202 configured to provide support for and secure the switch assembly 150, at least with respect to the first surface 110 of the console cover member 102, such that the switch assembly 150 is disposed between the support member 202 and the first surface 110. In such instances, the gasket member 120 may be disposed at least partially between the first surface 110 and the switch assembly 150, wherein the gasket member 120 is at least partially compressed therebetween, at least partially in response to the support member 202 being secured to the console cover member 102. In this regard, since the structure of the console cover member 102 and/or the upper end 52 of the door assembly 50 may prevent or otherwise hinder access to the first surface 110 (i.e., the underside of the upper portion 54, the support member 202 may be attached, secured, or otherwise operably engaged with the second surface 112 of the console cover member 102 (which is often more readily accessible), wherein the second surface 112 is perpendicularly engaged with and extends from one edge of the first surface 110. As such, according to particular aspects of the present invention, the support member 202 may be configured to bias the switch assembly 150 toward the first surface 110, upon being secured to the second surface 112, so as to compress the gasket member 120 between the first surface 110 and the switch assembly 150 and form the seal therebetween.

Accordingly, in some instances, the switch assembly 150 may be inserted generally parallel to and under the upper portion 54 of the console cover member 102, so as to be disposed adjacent to the first surface 110, wherein the gasket member 120 is at least partially disposed between the first surface 110 (i.e., the underside of the upper portion 54 of the console cover member 102) and the switch assembly 150. In such instances, the support member 202 may then be inserted into the console cover member 102, opposite the switch assembly 150 from the first surface 110, and secured/mounted to the second surface 112 of the console cover member 102. The console cover member 102 may be secured/mounted to the second surface 112 via, for example, fasteners 300, such as screws, extending through securing apertures 204 defined by the support member 202 and into corresponding fastener receiving structures 106 defined by the console cover member 102. One skilled in the art, however, will appreciate that the support member 202 may be secured to the second surface 112 in many different manners such as, for example, through various mechanisms implementing an interference fit.

In some embodiments of the present invention, the first surface 110 and/or the support member 202 may be configured to bias the switch assembly 150, or may otherwise include one or more biasing members configured to interact with and bias the switch assembly 150, toward the first surface 110. In another instance, one of the support member 202 and console cover member 102 (i.e., the first surface 110 and/or second surface 112) may comprise a biasing member (not shown) configured to cooperate with the other of the support member 202 and the console cover member 102 to direct the support member 202 toward the first surface 110, as the support member 202 is engaged with the second surface 112, More particularly, in one aspect, the support member 202 may comprise opposing first and second edges 212, 214, wherein the first edge 212 is disposed toward the second surface 112, and the biasing member may comprise at least one ramp member 220 operably engaged with the support member 202 and configured to diverge from the support member 202 between the first and second edges 212, 214 (i.e., in the direction of the second surface 112 in which the support member 202 is inserted into engagement with the console cover member 102). The at least one ramp member 220 may be further configured to engage the switch assembly 150 such that the at least one ramp member 220 urges the switch assembly 150 toward the first surface 110 (i.e., using a "wedge" principle) as the support member 202 is engaged with the second surface 112, via the fasteners 300/fastener receiving structures 106.

According to another aspect, as shown in FIG. 6, the console cover member 102 may include at least one ramp member 125 operably engaged with and extending outwardly of the second surface 112 (i.e., in conjunction with the fastener receiving structures 106 associated with the second surface 112 of the console cover member 102) wherein the at least one ramp member 125 is configured to diverge toward the second surface 112. Accordingly, the at least one ramp member 125 may be configured to interact with the support member 202 to urge the switch assembly 150 toward the first surface 110, as the support member 202 is engaged with the second surface 112. In any instance, the support member 202 is responsive to the biasing member to urge the switch assembly 150 toward the first surface 110 to compress the gasket member 120 therebetween. In any instance, the ramp members 125 may also be configured to reinforce the respective fastener receiving structure 106 for securing the support member 202 in the console cover member 102.

In such aspects, the one or more biasing devices may be configured to provide a sufficient compressive force exerted toward the first surface 110 for maintaining the switch assembly 150 proximate to the upper portion 54, while also creating a water-tight seal via compression of at least a portion of the gasket member 120, preferably without displacing or damaging the gasket member 120. Such a configuration may also facilitate the manufacturing process for dishwashers implementing such a switch assembly support system 200 by simplifying the switch assembly installation process with less risk of damage or misinstallations (and thus lower re-work probabilities).

In some additional aspects, the support member 202 may include a wall member 208 extending outwardly therefrom (i.e., toward the first surface 110), and at least partially along the second edge 214, for laterally retaining the switch assembly 150 in relation to the second surface 112. Further, the support member 202 may include a plurality of reinforcing members 210 operably engaged or otherwise associated therewith for reinforcing the support member 202 supporting the switch assembly 150. As particularly shown in FIG. 5, the reinforcing members 210 may be, for example, spaced-apart and configured such that each reinforcing member 210 extend between the first and the second edged 212, 214 thereof for reinforcing the support member 202 and the switch assembly 150, wherein the first edge 212 is adjacent to the second surface 112.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwashing appliance comprising:

a tub portion having a plurality of walls defining a forward access opening;

a door assembly pivotably engaged with the tub portion about respective lower ends thereof, the door assembly being movable between an open position and a closed position with respect to the tub portion, and configured to cooperate with the tub portion to cover the forward access opening in the closed position, the door assembly defining an upper end opposed to the lower end thereof;

a console cover member disposed about and operably engaged with the upper end of the door assembly, the console cover member having a first surface, and a second surface perpendicularly engaged with and extending from the first surface;

a switch assembly disposed within the console cover member, and having at least one control actuator configured to selectively direct operation of at least one operational component of the dishwashing appliance, the at least one control actuator being accessible through the first surface of the console cover member;

a gasket member operably engaged between the first surface and the switch assembly; and a support member configured to operably engage the second surface of the console cover member such that the switch assembly is disposed between the support member and the first surface, the support member being further configured to bias the switch assembly toward the first surface so as to compress the gasket member between the first surface and the switch assembly to form a seal therebetween.

2. A dishwashing appliance according to claim 1 wherein one of the support member and console cover member is configured to cooperate with the other of the support member and the console cover member to direct the support member toward the first surface as the support member is engaged with the second surface, the support member thereby being responsive to urge the switch assembly toward the first surface to compress the gasket member therebetween.

3. A dishwashing appliance according to claim 2 wherein the support member comprises opposing first and second edges, the first edge being disposed toward the second surface, and wherein at least one ramp member is operably engaged with the support member and configured to diverge from the support member between the first edge and the second edge, the at least one ramp member being configured to engage the switch assembly such that the at least one ramp member urges the switch assembly toward the first surface as the support member is engaged with the second surface.

4. A dishwashing appliance according to claim 1 wherein the console cover member includes at least one ramp member operably engaged with and extending outwardly of the second surface, the at least one ramp member being configured to diverge toward the second surface, the at least one ramp member being configured to interact with the support member to urge the switch assembly toward the first surface as the support member is engaged with the second surface.

5. A dishwashing appliance according to claim 1 wherein the support member comprises opposing first and second edges, the first edge being disposed toward the second surface, and the support member further comprises a wall member extending outwardly therefrom and at least partially along the second edge for retaining the switch assembly in relation to the second surface.

6. A dishwashing appliance according to claim 1 wherein the support member comprises opposing first and second edges, the first edge being disposed toward the second surface, and the support member further comprises a plurality of reinforcing members engaged therewith, the reinforcing members being spaced-apart and each reinforcing member extending between the first and second edges, for reinforcing the support member and supporting the switch assembly.

7. A dishwashing appliance according to claim 1 wherein the support member further defines at least one securing aperture configured to receive a corresponding fastener therethrough, the at least one securing aperture being configured to cooperate with a corresponding fastener receiving structure defined by the second surface of the console cover member such that the support member is capable of being secured to the console cover member by the corresponding fastener.

8. A switch assembly support system for a dishwashing appliance having a tub portion defining a forward access opening, the dishwashing appliance having a door assembly being pivotably engaged with the tub portion about respective lower ends thereof, the door assembly being movable between an open position and a closed position with respect to the tub portion, and adapted to cooperate with the tub portion to cover the forward access opening in the closed position, the door assembly defining an upper end opposed to the lower end thereof, the dishwashing appliance further comprising a switch assembly having at least one control actuator configured to selectively direct operation of at least one operational component of the dishwashing appliance, the switch assembly having a gasket member operably engaged therewith, the switch assembly support system comprising:

a console cover member configured to be disposed about and operably engaged with the upper end of the door assembly, the console cover member having a first surface, and a second surface perpendicularly engaged with and extending from the first surface, the at least one control actuator being accessible through the first surface; and a support member configured to operably engage the second surface of the console cover member such that the switch assembly is disposed between the support member and the first surface, the support member being further configured to bias the switch assembly toward the first surface so as to compress the gasket member between the first surface and the switch assembly to form a seal therebetween.

9. A switch assembly support system according to claim 8 wherein one of the support member and console cover member is configured to cooperate with the other of the support member and the console cover member to direct the support member toward the first surface as the support member is engaged with the second surface, the support member thereby being responsive to urge the switch assembly toward the first surface to compress the gasket member therebetween.

10. A switch assembly support system according to claim 9 wherein the support member comprises opposing first and second edges, the first edge being disposed toward the second surface, and wherein at least one ramp member is operably engaged with the support member and configured to diverge from the support member between the first edge and the second edge, the at least one ramp member being configured to engage the switch assembly such that the at least one ramp member urges the switch assembly toward the first surface as the support member is engaged with the second surface.

11. A switch assembly support system according to claim 8 wherein the console cover member includes at least one ramp member operably engaged with and extending outwardly of the second surface, the at least one ramp member being configured to diverge toward the second surface, the at least one ramp member being configured to interact with the support member to urge the switch assembly toward the first surface as the support member is engaged with the second surface.

12. A switch assembly support system according to claim 8 wherein the support member comprises opposing first and second edges, the first edge being disposed toward the second surface, and the support member further comprises a wall member extending outwardly therefrom and at least partially along the second edge for retaining the switch assembly in relation to the second surface.

13. A switch assembly support system according to claim 8 wherein the support member comprises opposing first and second edges, the first edge being disposed toward the second surface, and the support member further comprises a plurality of reinforcing members engaged therewith, the reinforcing members being spaced-apart and each reinforcing member extending between the first and second edges, for reinforcing the support member and supporting the switch assembly.

14. A switch assembly support system according to claim 8 wherein the support member further defines at least one securing aperture configured to receive a corresponding fastener therethrough, the at least one securing aperture being configured to cooperate with a corresponding fastener receiving structure defined by the second surface of the console cover member such that the support member is capable of being secured to the console cover member by the corresponding fastener.

15. A method of forming a pivotable door assembly of a dishwashing appliance, the method comprising:

operably engaging a console cover member with and about an upper end of a door member, the console cover member having a first surface, and a second surface perpendicularly engaged with and extending from the first surface;

placing a switch assembly within the console cover member such that at least one control actuator associated with the switch assembly, and configured to selectively direct operation of at least one operational component of the dishwashing appliance, is accessible through the first surface of the console cover member;

operably engaging a gasket member between the first surface and the switch assembly and:

operably engaging a support member with the second surface of the console cover member such that the switch assembly is disposed between the support member and the first surface, the support member being configured to bias the switch assembly toward the first surface so as to compress the gasket member between the first surface and the switch assembly to form a seal therebetween.

16. A method according to claim 15 wherein operably engaging a support member further comprises operably engaging a support member having opposing first and second edges, the first edge being disposed toward the second surface, and the support member further having at least one ramp member operably engaged therewith, the ramp member being configured to diverge from the support member between the first edge and the second edge, and to engage the switch assembly such that the at least one ramp member urges the switch assembly toward the first surface as the support member is engaged with the second surface.

17. A method according to claim 15 wherein operably engaging a console cover member further comprises operably engaging a console cover member having at least one ramp member operably engaged therewith and extending outwardly of the second surface, the at least one ramp member being configured to diverge toward the second surface, and to interact with the support member to urge the switch assembly toward the first surface as the support member is engaged with the second surface.

18. A method according to claim 15 wherein operably engaging a support member further comprises operably engaging a support member having opposing first and second edges, the first edge being disposed toward the second surface, and the support member further having a wall member extending outwardly therefrom and at least partially along the second edge for retaining the switch assembly in relation to the second surface.

19. A method according to claim 15 wherein operably engaging a support member further comprises operably engaging a support member having opposing first and second edges, the first edge being disposed toward the second surface, and the support member further having a plurality of reinforcing members engaged therewith, the reinforcing members being spaced-apart and each reinforcing member extending between the first and second edges, for reinforcing the support member and supporting the switch assembly.

20. A method according to claim 15 wherein operably engaging a support member further comprises operably engaging a support member defining at least one securing aperture configured to receive a corresponding fastener therethrough, the at least one securing aperture being configured to cooperate with a corresponding fastener receiving structure defined by the second surface of the console cover member such that the support member is secured to the console cover member by the corresponding fastener.

* * * * *